US005553362A

United States Patent [19]

Stevens

[11] Patent Number: 5,553,362

[45] Date of Patent: Sep. 10, 1996

[54] WRAPPING DEVICE FOR SHAPING FABRICS TO 3-D CONTOURS

[75] Inventor: Kenneth V. Stevens, Brooklyn, N.Y.

[73] Assignee: PRescient Partners L.P., New York, N.Y.

[21] Appl. No.: 565,834

[22] Filed: Dec. 1, 1995

[51] Int. Cl.[6] ..... A47C 31/00

[52] U.S. Cl. ..... 24/326; 24/72.5; 24/462; 242/388.1; 297/225

[58] Field of Search ..... 29/91, 91.3, 91.5, 29/91.6, 91.7, 91.8; 297/218.5, 225, 228.13; 242/388.1, 405, 405.1; 5/498; 24/68 R, 68 SC, 68 D, 68 F, 326, 72.5, 459, 462

[56] References Cited

U.S. PATENT DOCUMENTS 1,825,909 10/1931 Levi .
1,857,418 5/1932 Welder .
2,884,993 5/1959 Schutte .
4,901,388 2/1990 Irwin ..... 5/498
5,320,407 6/1994 Tell .
5,467,491 11/1995 Griffith ..... 24/72.5 X

FOREIGN PATENT DOCUMENTS 2853009 6/1980 Germany ..... 29/91

*Primary Examiner*—James R. Brittain
*Attorney, Agent, or Firm*—Notaro & Michalos

[57] ABSTRACT

An apparatus and method for fitting an unstructured fabric furniture cover to a piece of furniture includes an elongated triangular wrapping member. Excess fabric at the corner areas of the piece of furniture is wrapped around the triangular member and fitted to the corner area of the furniture. A clip or band is used to hold the wrapped excess fabric against the corner area for fitting the unstructured fabric cover to the piece of furniture.

14 Claims, 7 Drawing Sheets

WRAPPING DEVICE FOR SHAPING FABRICS TO 3-D CONTOURS

FIELD AND BACKGROUND OF THE INVENTION

The present invention relates in general to furniture, and in particular, a new and useful apparatus for gathering and holding the corners of unstructured fabric furniture covers so that the covers conform well to the furniture.

The use of unstructured fabric furniture covers on sofas and chairs has grown markedly over the past few years. Accessory products have recently been developed to address some of the problems with furniture covers in use. See, for example, U.S. patent applications Ser. Nos. 08/417,933 and 08/270,057, filed Apr. 6, 1995 and Jul. 1, 1994 respectively, and co-invented by the present inventor.

Included among the problems are loose, messy fit; disheveled appearance; and erratic pleating at the arms. The present invention is intended to give the cover user additional control over the placement and maintenance of fabric covers on furniture.

Typically, according to the manufacturers' instructions, an unstructural furniture cover, that is, a large, flat, fabric rectangle, is draped over a sofa and hand-tucked around the seating perimeter. The fabric, now formed to the cushion area, runs over the arms and front and up and over the back of the sofa, hanging loosely in folds or bunches. Next, the cover makers suggest that excess fabric spilling onto the floor be tucked under the sofa. Then an elasticized skirt is placed about the base of the sofa as a means of containing the untidy outer folds with a finishing touch. For a more regular, tailored look, the makers recommend the use of screw pins to hold particular pleats and folds in place. Screw pins are also suggested as a means of holding the skirt to the cover and also for anchoring the whole assembly to the sofa upholstery itself. As a final controlling hint, the makers suggest strategically hand-tacking the cover and skirt with needle and thread.

U.S. Pat. No. 1,825,909 discloses the use of elastic cords connected to various portions of a furniture slip-cover, for structuring the cover closely around furniture such as an armchair or sofa. U.S. Pat. No. 1,857,418 discloses initially unstitched seams in a partially structured furniture cover which, to achieve a final fit, are stitched after the cover is fitted onto the furniture.

U.S. Pat. No. 2,884,993 discloses the use of bands and fasteners for fitting a slip cover to a chair or sofa. U.S. Pat. No. 5,320,407 discloses the use of tubes which are stitched in the portions of a slipcover which will eventually cover inner or outer corner areas of the furniture, and pull cords in the stitched tubes. After covering the sofa or chair, the cords are pulled to gather the cover at the corner areas, thus producing shirring effect.

None of the references suggest any method or apparatus which is capable of converting an unstructured furniture cover, such as a simple rectangular sheet of fabric, into a cover which conforms closely to the furniture.

SUMMARY OF THE INVENTION

Accordingly, an object of the present invention is to provide an apparatus for fitting an unstructured fabric furniture cover to a piece of furniture, the cover having excess fabric at a corner area of the piece of furniture, the apparatus comprising: an elongated triangular wrapping member having a short base area and two adjacent sides extending outwardly from the base area and being connected to each other at an end of the triangular wrapping member which is opposite from the base area. The wrapping member has a longitudinal axis extending between the base area and the opposite end. Catch means at the base area are provided for catching a portion of the excess fabric at the corner area of the piece of furniture, so that when the wrapping member is rotated around the longitudinal axis, the excess fabric is gathered around the wrapping member and toward the corner area. Holding means hold the wrapping member and gathered excess fabric therearound, against the corner area of the piece of furniture.

A further object of the present invention is to provide a method for fitting an unstructured fabric furniture cover to a piece of furniture which comprises wrapping excess fabric at a corner area of the piece of furniture, around an elongated triangular wrapping member by rotating the wrapping member around its longitudinal axis to gather the excess fabric around the wrapping member, and holding the gathered fabric with wrapping member therein, against the corner area of the piece of furniture.

It is the intention of the present invention to give a person the ability to dress a furniture cover to the shape of a sofa or chair in a snug, tightly conforming manner. At present, short of extensive pinning and/or meticulous hand sewing, no techniques or devices available afford this possibility. By using the invention one can easily turn the cover into a near-second skin on the sofa and also easily remove the cover for cleaning.

Although the present invention works well with a flat, rectangular sheet of fabric used as the unstructured fabric cover, it also works with any other shape of fabric sheet. The significance of the present invention is that any excess area can be neatly wrapped and gathered in a way which was not possible in the past.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the inventions are illustrated.

DESCRIPTION OF THE PREFERRED EMBODIMENTS

Figure 1:
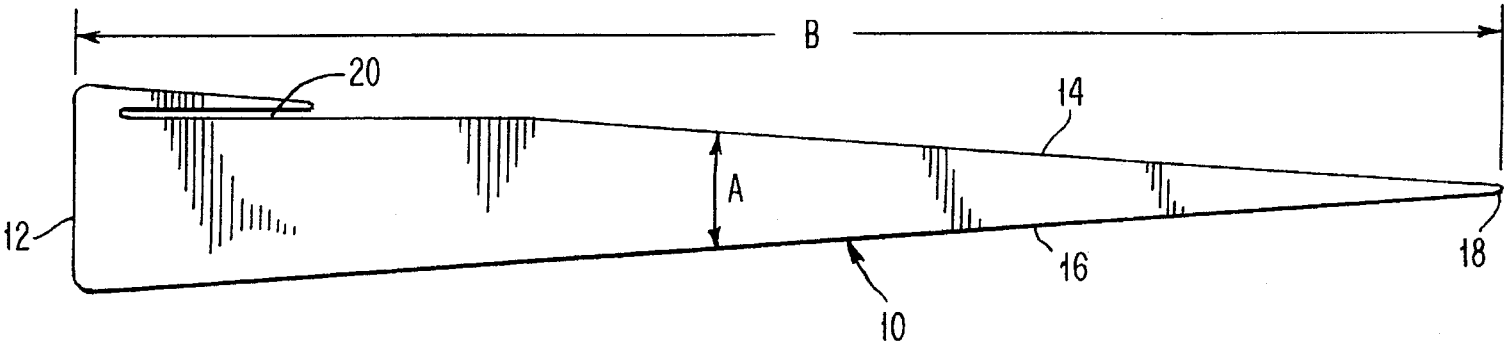
FIG. 1 is a top plan view of a wrapping member in accordance with a first embodiment of the present invention.

Referring to the drawings in particular, the invention embodied in FIG. 1, comprises a wrapping member generally designated 10 for use in fitting an unstructured fabric furniture cover to a piece of furniture, in particular for gathering excess fabric in the corner areas of the piece of furniture. Wrapping member 10 has a short base area 12 and two adjacent sides 14, 16 which extend outwardly from the base area and which are connected to each other at an opposite end 18 of the triangular wrapping member 10. Catch means, which in the embodiment of FIG. 1 comprise a longitudinally extending slot 20 at the base area 12, are used to catch a portion of the fabric cover in preparation for a wrapping operation. Although slot 20 is shown at one side of the member 10, the slot may be positioned at any location at the base area, for example, starting at the base line of the triangular member and extending longitudinally for a short distance toward the opposite end 18 of the member.

Figure 2:
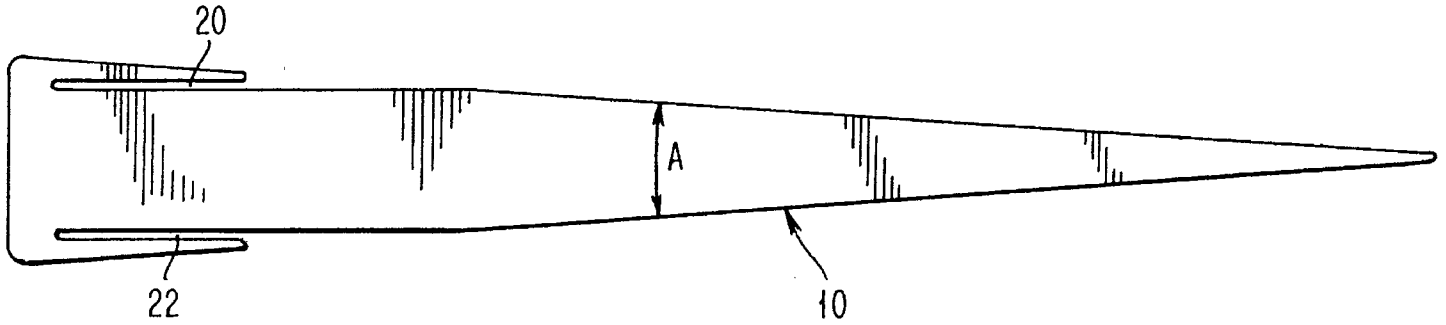
FIG. 2 is a view similar to FIG. 1 of a second embodiment of the invention.

FIG. 2 illustrates a second embodiment of the invention which includes a pair of slots 20 and 22. It is noted that throughout the drawings, the same reference numbers will be utilized to designate the same or functionally similar parts.

Figure 3:
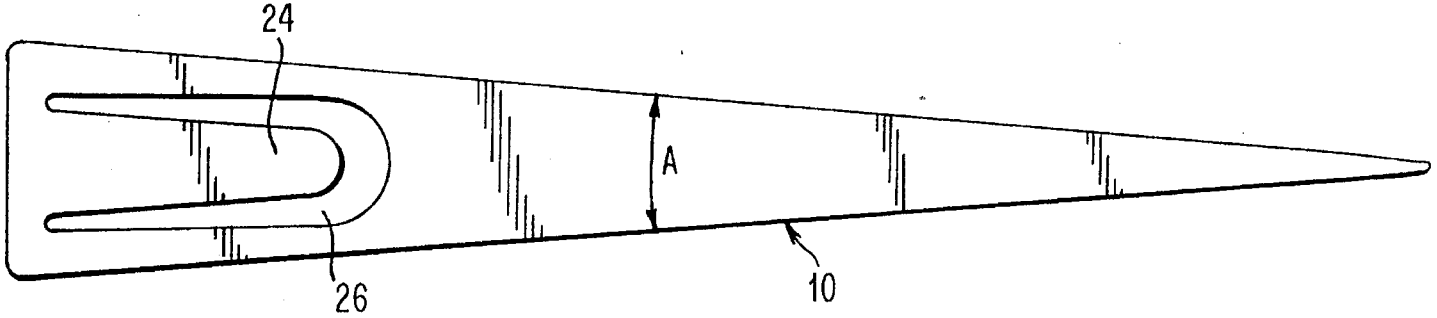
FIG. 3 is a view similar to FIG. 1 of a third embodiment of the invention.

In the embodiment of FIG. 3, the catch means is in the form of a tab 24 formed by cutting out a U-shaped slot 26 from the material of member 10.

The embodiments of FIGS. 1, 2 and 3 can be made of a single piece of die-cut synthetic material such as plastic, acrylic or other known material having sufficient rigidity to support the wrapping operation of the present invention, to be described later in this disclosure. The invention is also not limited to synthetic plastic in that the wrapping member may be made of a thin strip of wood, metal or any other suitable material.

In similar fashion, the catch means at the base area end of the member can be embodied in any conceivable fashion in addition to those illustrated. It is only necessary that the fabric be momentarily held against the base area of the triangular wrapping member 10 during the beginning stages of the wrapping operation.

Figure 4:
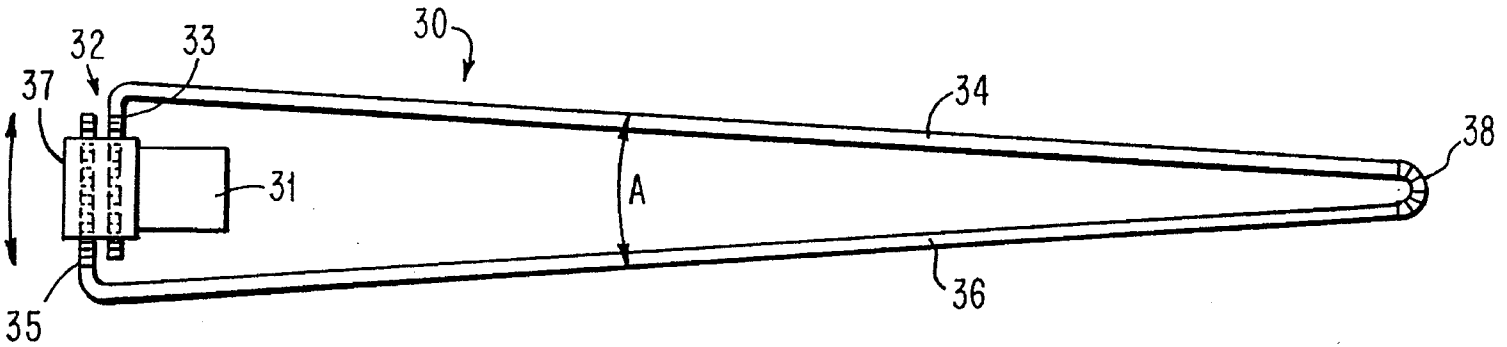
FIG. 4 is a view similar to FIG. 1 of a fourth embodiment of the invention.

FIG. 4 illustrates a further embodiment of the wrapping member which in FIG. 4 is generally designated 30. The base area 32 comprises a pair of inwardly bent ends in 33, 35 of a pair of rod portions 34, 36 which form the sides of the wrapping member. The opposite end 38 of member 30 is a flexible apex connecting the side members to each other.

Figure 5:
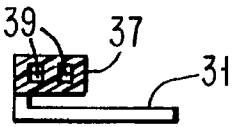
FIG. 5 is a partial sectional view of a portion of the embodiment of FIG 4.

An adjustment block 37 has a pair of holes 39 as best shown in FIG. 5, each for receiving one of the inwardly bent ends 33, 35. Each of the bent ends 33, 35 has a series of teeth which engage a detente in the holes 39, for momentarily but firmly holding the bent ends in the block 37. A clip 31 is attached to block 37 and forms the catch means in, the embodiment of FIG. 4.

Figure 6:
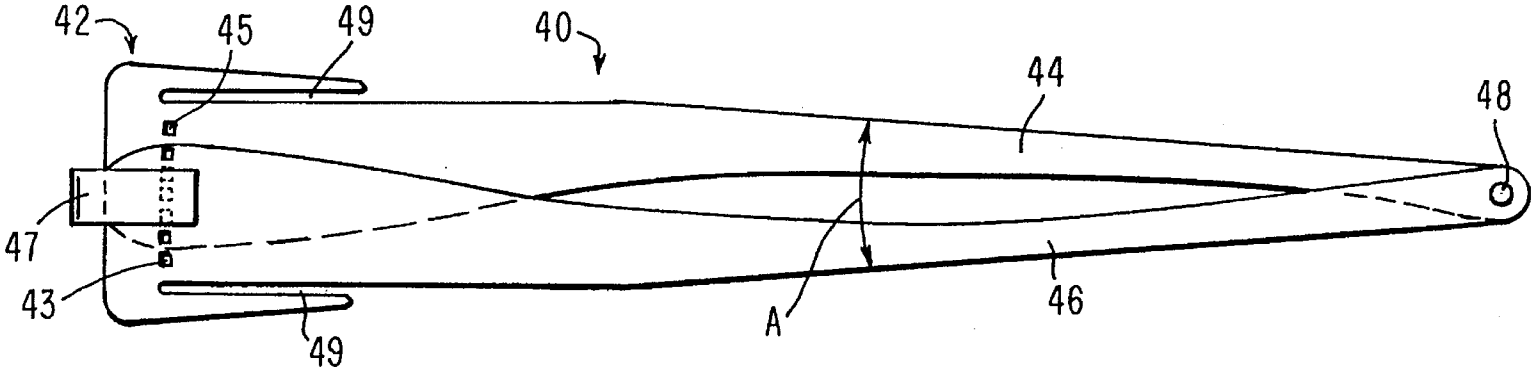
FIG. 6 is a view similar to FIG. 1 of a sixth embodiment of the invention.

FIG. 6 illustrates a further embodiment of the wrapping member generally designated for 40, formed of a pair of side members 42 and 46 which are pivotedly connected to each other at a pivot pin, grommet or the rivet structure 48.

In the base area 42 of the embodiment of FIG. 6, the side members 44 and 46 are enlarged. One of these enlarged areas includes an arcuate line of spaced agritures 43 and the other enlarged portion includes an arcuate line of spaced detentes 46. A base clip 47 serves to bias the broad surfaces of the enlarged ends against each other to fix a selected angular position between the side members 44, 46 by allowing one or more of the detentes from one member to engage with the apertures of the other member. Clip 47 can be removed so that the angle A between the side members can be adjusted.

Figure 7:
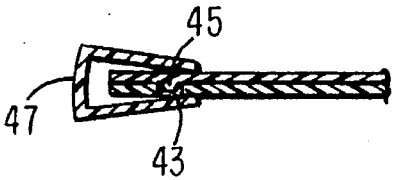
FIG. 7 is a partial sectional view of a portion of the embodiment of FIG. 6.

FIG. 7 illustrates the engagement of one detente 45 and one aperture 43 and the holding of this position by clip 47.

In both the embodiments of FIG. 4 and 6, the angle A can be adjusted.

It is noted that the same material that is used to make the embodiments of FIGS. 1—3, can be used to make the rod material of FIG. 4 and the side members of FIG. 6. As in the embodiments of FIGS. 1—4, catch means are provided in the embodiment of FIG. 6, for example, in the form of longitudinally extending slots 49, which may be in one or both of the side members 44, 46.

The inventor has found the overall length of the wrapping member illustrated at B in FIG. 1 to advantageously be between 6 inches and 36 inches with the preferred range being between 12 inches and 24 inches. These are all approximate measurements and are applicable to all embodiments of the wrapping member in FIGS. 1—7.

The angle A must be acute and the inventor has found it should be approximately 3–30 degrees, but preferable 5–15 degrees. The thickness of the wrapping member is advantageously about 1/32 of an inch—2 inches and preferably 1/16 of an inch—½ an inch. These angles and thicknesses are also applicable to all embodiments of the invention, and may be selected, like the length, also depending on which corner of the furniture is to be treated.

The best mode of the invention, at least as currently formulated, utilizes an angle of 8 degrees for angle A with a length of about 21–22 inches in one working embodiment of FIGS. 2 and 3 for a back sofa corner, and a length of about 17 ½ inches with an angle of 10 degrees for a second working embodiment of the embodiment of FIG. 3 for an arm corner of a sofa.

The angles and length can be selected to adjust the characteristics of a pleating effect which takes place during the wrapping operation as will be explained in connection with FIGS. 10 and 11.

In addition to die-cut materials for the wrapping members, the materials can be saw cut from sheet stock or injection molded. The wrapping member can also be fabricated of bonded wire, rod or tubing, in particular, for the embodiment of FIG. 4. Further in the embodiment of FIG. 4, the sides 34 and 36 can include a telescoping feature so that both the length and the angle can be adjusted for optimum use. Further, in the embodiments of FIGS. 4 and 6, any hinge mechanism can be utilized for the pivot or hinge ends 38, 48.

Figure 8:
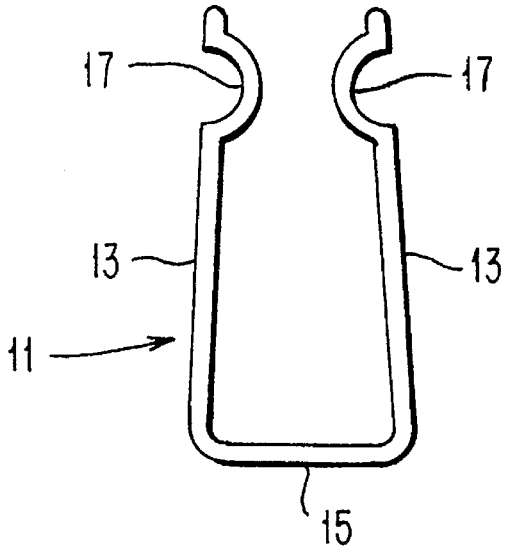
FIG. 8 is a side elevational view of a clip which is used as one embodiment of a catch means according to the present invention.
Figure 9:
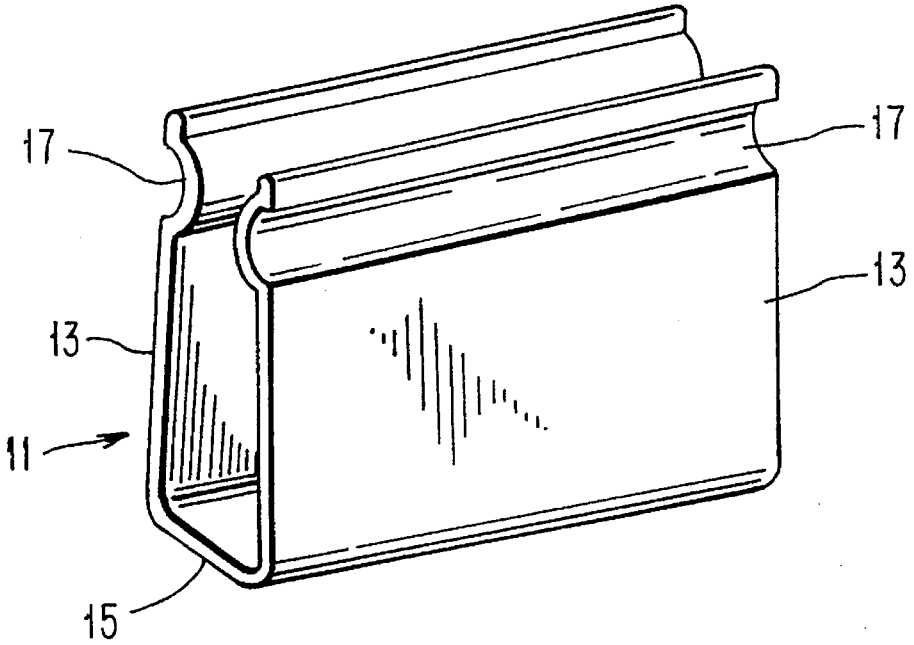
FIG. 9 is a prospective view of the clip of FIG. 8.

FIG. 8 illustrates an outer clip, generally designated 11 which forms holding means of the present invention for holding the wrapped fabric cover. Holding clip 11 is advantageously made of metal or rigid plastic and has a pair of arms 13 connected to each other by a base 15 and each having, near their free ends, an inwardly extending clamping projection 17, 17 for example in the form of a semi-circular bend in the legs 13, 13. This helps clamp the fabric in its wrapped condition to secure the form fit on the piece of furniture.

Figure 10:
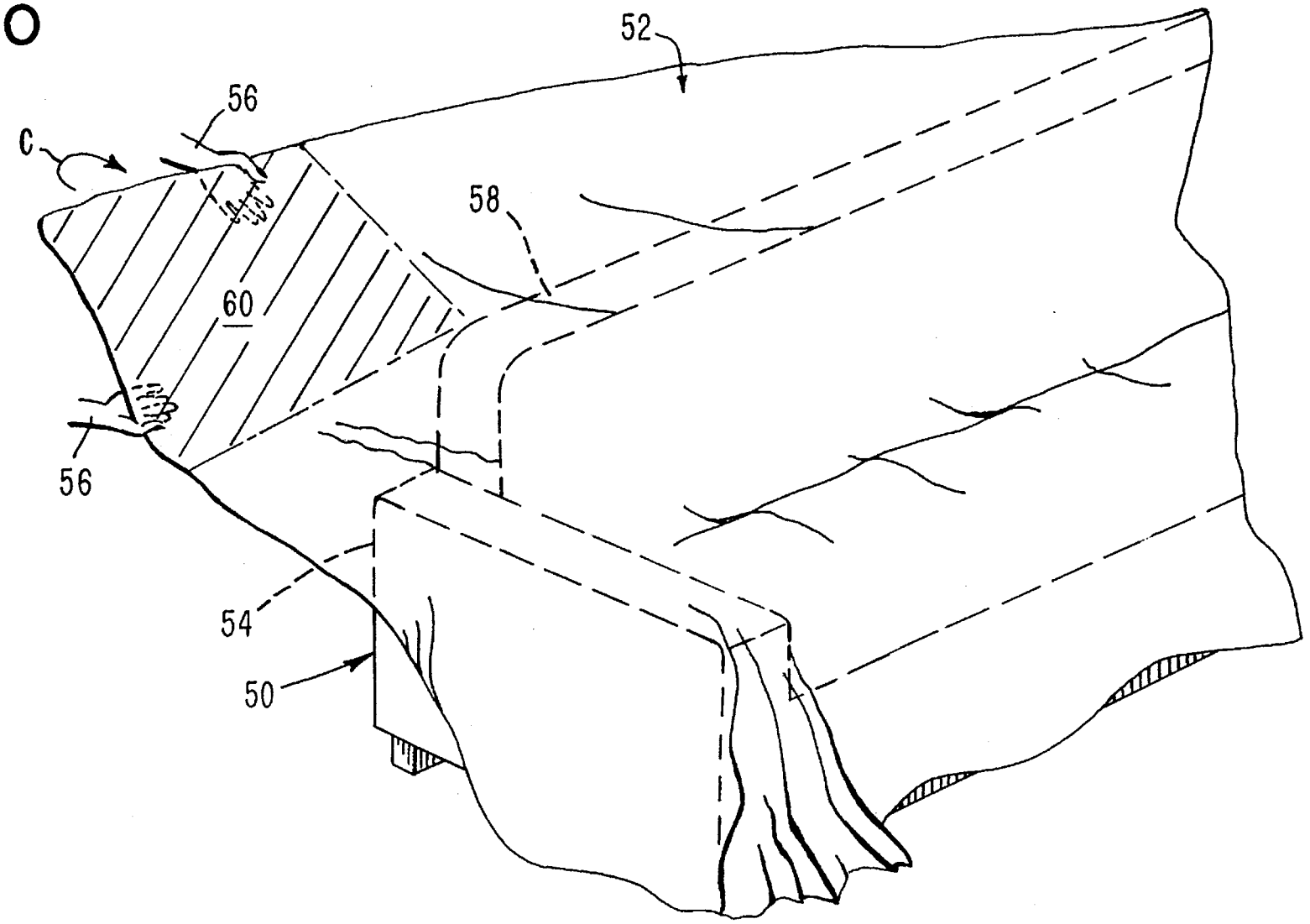
FIG. 10 is partial perspective view of a piece of furniture and an unstructured fabric cover to be fitted with the apparatus and according to the method of the present invention.
Figure 11:
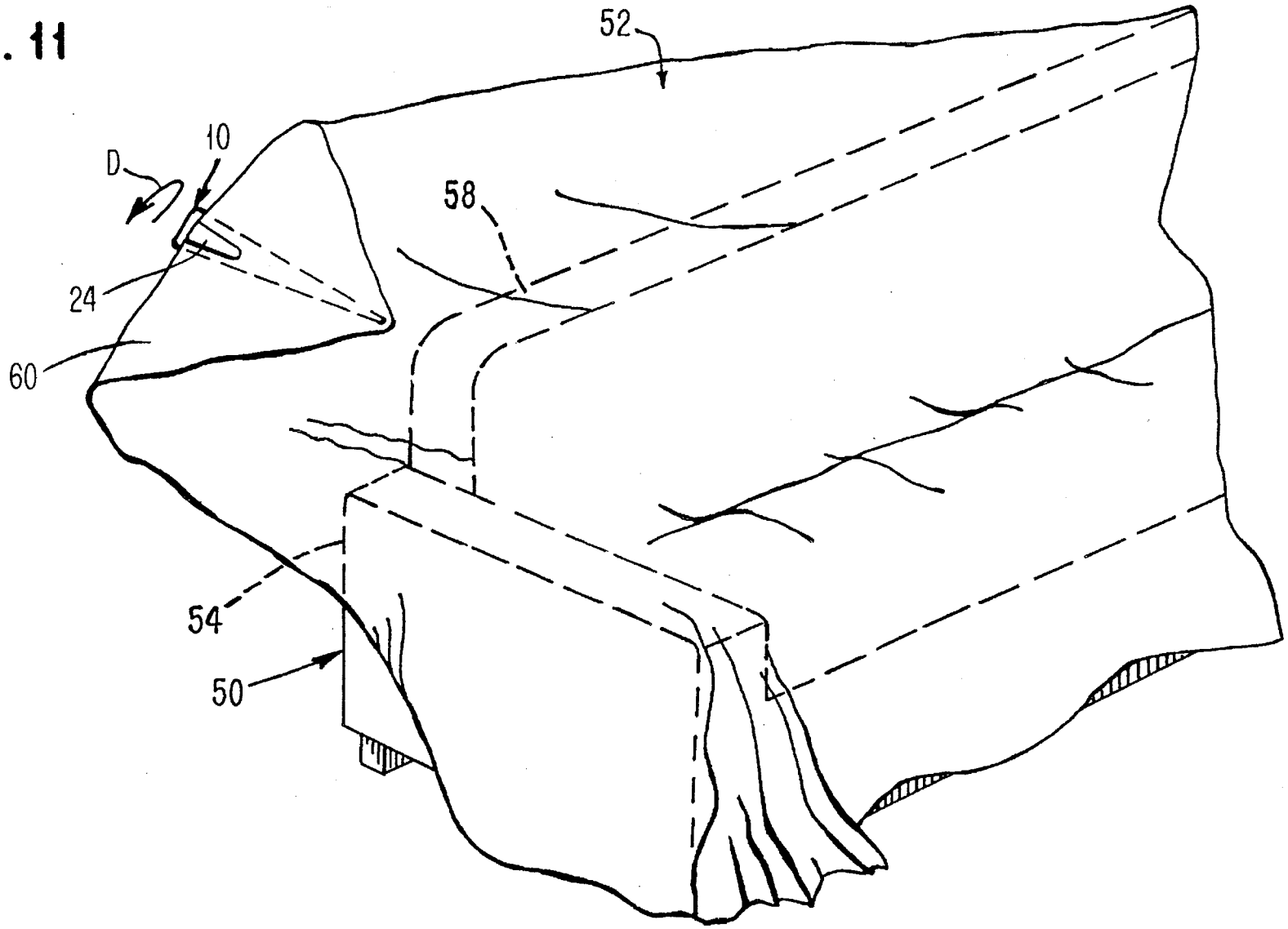
FIG. 11 is a view similar to FIG. 10 illustrating initial steps of the process.

Referring to FIG. 10, a piece of furniture in the form of a sofa 50 is to be wrapped with an unstructured furniture cover 52, which may simply be a large flat sheet of appropriate fabric. In the following, the reader is given specific instructions on how to use the apparatus of the present invention to practice the method of the present invention.

After the cover 52 has been placed on the sofa 50 and tucked in around the seat cushion of the sofa, go to one of the rear corners 54 of the sofa. Face the corner and pick up the cover. With hands 56 apart, hold the excess fabric of the cover and spread it out at the level of the top of the sofa 58. The excess fabric is shown as a shaded area 60.

Fold the corner of the excess fabric over and inwardly toward the sofa in the direction of arrow C. At the center of the fold, place the wrapping member 10 under the cover until it nears the sofa corner and attach the catch means 24 as shown in FIG. 11. Position on hand over the wrapping member. Being careful to avoid wrinkles, begin twisting the base of the wrapping member into the attached fabric, in the direction of arrow D, around the longitudinal axis of the wrapping member. Each turn will take up two triangular segments of free fabric. Remove the hand as the member enfolds more and more cover fabric and the twist of wrap-and-cover moves downwardly toward the floor at the sofa corner 54. Keep twisting the wrapping member until it meets the sofa back snugly at the corner.

Figure 12:
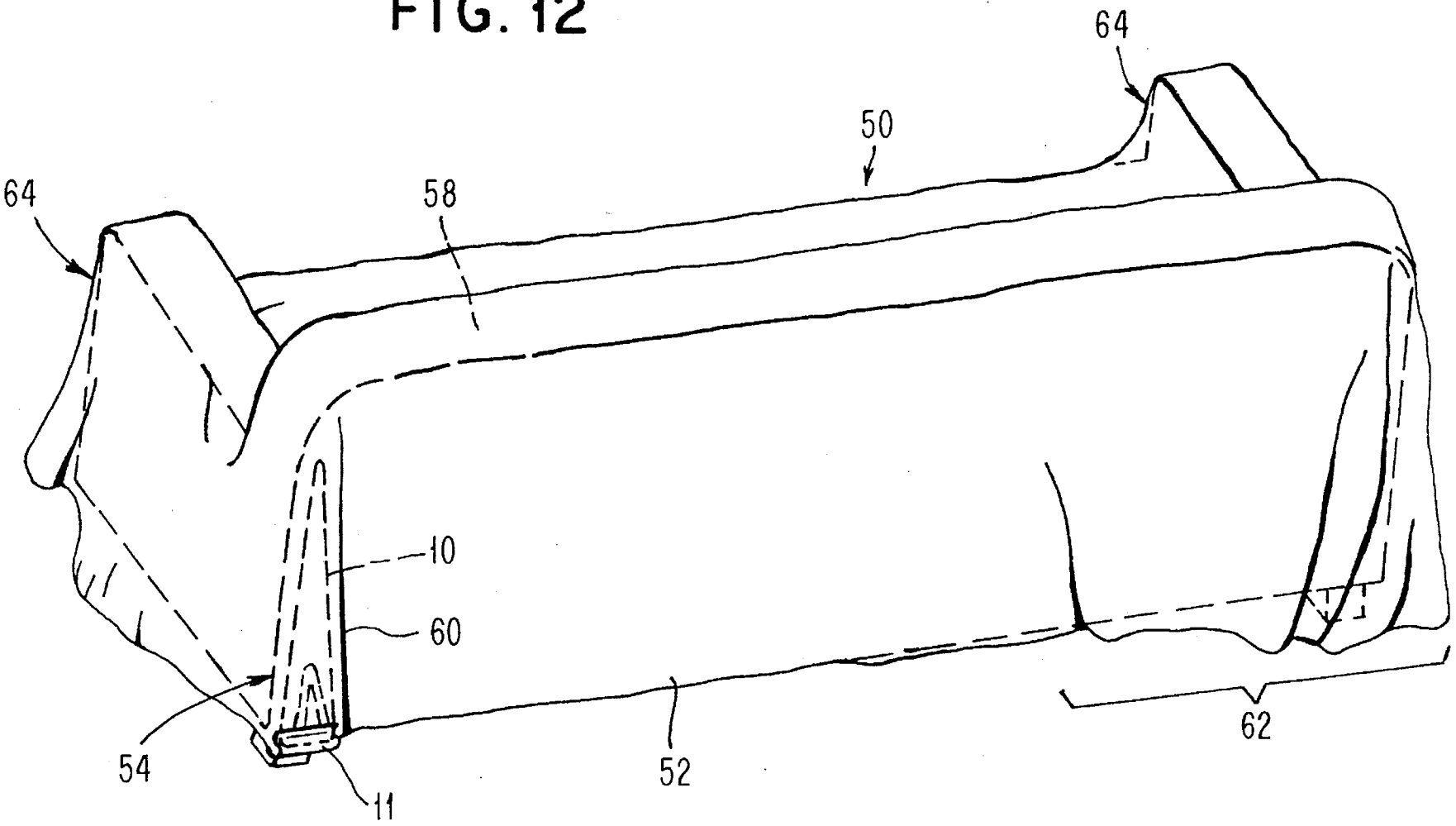
FIG. 12 is a rear perspective view of a piece of furniture with a partially fitted unstructured fabric cover thereon wrapped according to the present invention.
Figure 13:
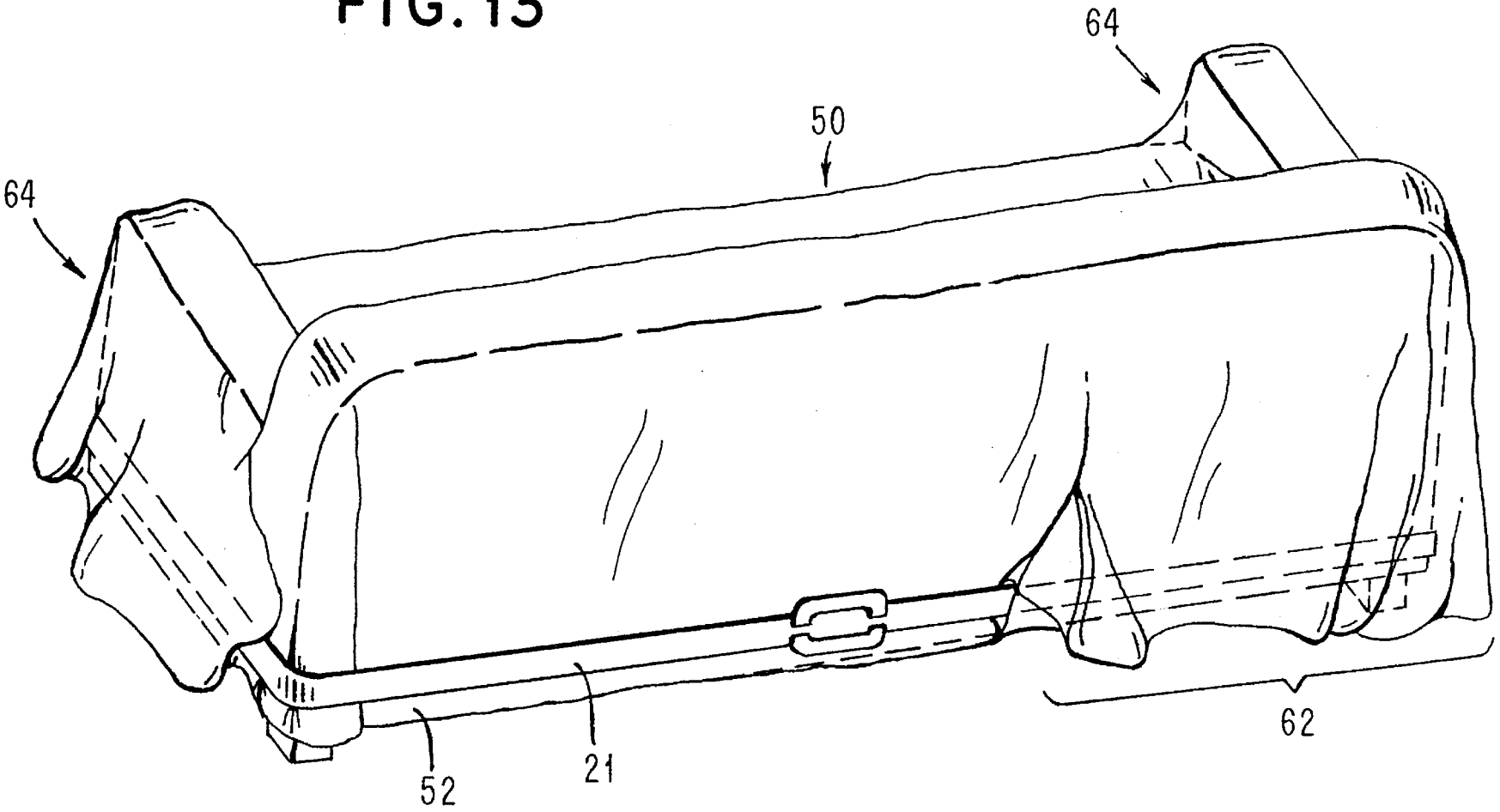
FIG. 13 is a view similar to FIG. 12 illustrating another catch means for use in accordance with the present invention.

Attach the external holding clip 11 to the twist making sure to capture the layer of cover closest to the sofa as shown in FIG. 12. FIG. 13 illustrates another embodiment of the holding means in the form of an elastic band 21 over the twisted fabric to hold it in place.

The process of the invention is repeated at the other rear corner and at a front corner/arm of the sofa. Repeat the operation at each arm with a shorter wrapping member if the arm height is lower than the back. The use of an even shorter wrapping member at the arm can yield a decorative curved twist above the final triangle of wrapped fabric. The cover should now be tightly drawn to the sofa. An elasticized skirt (not shown) can now be placed around the sofa base.

FIGS. 12 and 13 show an area 62 at the opposite corner of the sofa which has not yet been wrapped, illustrating the disheveled condition of the unstructured sofa cover before it is subjected to the present invention. The same is true of the arm areas 64 which, for the purpose of the present invention, are examples of corner areas of the sofa where excess fabric would remain unless it were wrapped and fitted according to the present invention.

While specific embodiments of the invention have been shown and described in detail to illustrate the application of the principles of the invention, it will be understood that the invention may be embodied otherwise without departing from such principles.

What is claimed is:

1. An apparatus for fitting an unstructured fabric cover to a structure, the cover having excess fabric at a corner area of the structure, the apparatus comprising:

an elongated triangular wrapping member having a short base area and two adjacent sides extending outwardly from the base area and being connected to each other at an end of the triangular wrapping member which is opposite from the base area, the wrapping member having a longitudinal axis extending between the base area and the opposite end;

catch means at the base area for catching a portion of the excess fabric at the corner area of the structure, so that when the wrapping member is rotated around the longitudinal axis, the excess fabric is gathered around the wrapping member and toward the corner area; and holding means for holding the wrapping member and gathered excess fabric therearound, against the corner area of the structure.

2. An apparatus according to claim 1, wherein the adjacent sides form of angle of from about 3 to about 30 degrees, the triangular wrapping member having a length along its longitudinal axis of about 6 to 36 inches and the wrapping member having a thickness of about 1/32 of an inch to about 2 inches.

3. An apparatus according to claim 1, wherein the wrapping member is made of a single flat triangular sheet of material.

4. An apparatus according to claim 3, wherein the catch means comprises a longitudinal slot formed in the one piece of material in the base area.

5. An apparatus according to claim 4, wherein the slot is in at least one of the adjacent sides.

6. An apparatus according to claim 4, wherein the slot is U-shaped and forms a tab in the base area, the tab also comprising part of the catch means.

7. An apparatus according to claim 1, wherein the adjacent sides comprise a pair of rods connected to each other by a flexible connection at the opposite end of the wrapping member, the base area comprising each rod having an inwardly bent end and a block for receiving the inwardly bent end of each rod.

8. An apparatus according to claim 7, including detente means for holding the inwardly bent ends of the rods at selected positions with respect to each other for adjusting an acute angle between the adjacent sides.

9. An apparatus according to claim 7, including a clip connected to said block and forming said catch means.

10. An apparatus according to claim 1, wherein said adjacent sides comprise a pair of flat, elongated members which are pivotedly connected to each other at the opposite end of said wrapping member, each flat elongated member having an enlarged portion at said base area with said enlarged portions overlapping, said wrapping member including detente means for adjusting an amount of overlap between said flat, elongated portions for adjusting an acute angle between said adjacent sides.

11. An apparatus according to claim 10, wherein said detente means comprise an arcuate line of apertures in one of said enlarged portions and at least one detente in the other of said enlarged portions, and a base clip for holding said enlarged portions against each other for engaging said detente in one of said apertures.

12. An apparatus according to claim 1, wherein said holding means comprises a holding clip sized to engage around the wrapping member with excess fabric wrapped therearound.

13. An apparatus according to claim 12, wherein said clip has a pair of arms, a base connected between said pair of arms and clamping projections in each arm, said clip being made of resilient material for biasing said clamping projections toward each other.

14. An apparatus according to claim 1, wherein said holding means comprises an elastic band for engagement around the structure and over the wrapping member with excess fabric wrapped therearound.

* * * * *